US006331103B1

(12) United States Patent
Teraoka

(10) Patent No.: US 6,331,103 B1
(45) Date of Patent: Dec. 18, 2001

(54) FLUID MACHINE HAVING A PAIR OF ROTORS AND A SILENCER

(75) Inventor: Masao Teraoka, Tochigi (JP)

(73) Assignee: Tochigi Fuji Sangyo Kabushiki Kaisha (JP)

( * ) Notice: Subject to any disclaimer, the term of this patent is extended or adjusted under 35 U.S.C. 154(b) by 0 days.

(21) Appl. No.: 09/301,791

(22) Filed: Apr. 29, 1999

(30) Foreign Application Priority Data

Apr. 30, 1998 (JP) ..... 10-121172

(51) Int. Cl.[7] ..... F01C 1/16; F01C 21/00; F04C 29/06

(52) U.S. Cl. ..... 418/181; 418/201.1

(58) Field of Search ..... 418/181, 201.1, 418/206.1; 417/312

(56) References Cited

U.S. PATENT DOCUMENTS

| | | | | |
|---|---|---|---|---|
| 1,207,239 | * | 12/1916 | Templin | 417/312 |
| 3,736,074 | * | 5/1973 | Kilbane et al. | 417/312 |
| 5,208,429 | * | 5/1993 | Field | 418/181 |
| 6,004,119 | * | 12/1999 | Hamasaki et al. | 418/181 |

FOREIGN PATENT DOCUMENTS

| | | | | |
|---|---|---|---|---|
| 54-54309 | | 4/1979 | (JP) . | |
| 57-186684 | | 4/1982 | (JP) . | |
| 60-1389 | * | 1/1985 | (JP) | 417/312 |
| 4-86394 | * | 3/1992 | (JP) | 418/181 |
| 5-47373 | | 6/1993 | (JP) . | |
| 5-57386 | | 7/1993 | (JP) . | |
| 6-80026 | | 11/1994 | (JP) . | |

* cited by examiner

*Primary Examiner*—John J. Vrablik
(74) *Attorney, Agent, or Firm*—Morrison & Foerster

(57) ABSTRACT

A fluid machine includes: a casing having an operating chamber provided in the casing; a pair of rotors rotatably mounted in the operating chamber which have each rotor shaft in each axial direction; an intake opening and discharge opening for fluid and are connected with the operating chamber, respectively; and silencing means provided in at least one of an existing space forming fluid channel on the intake opening side and an existing space forming a fluid channel on the discharge opening side. In the structure, the existing spaces are located between the intake opening and the operating chamber and between the discharge opening and the operating chamber, respectively. Furthermore, at least one among the intake opening and the discharge opening of the fluid where the silencing means is disposed is provided so as to be at parallel with the rotor shafts.

9 Claims, 10 Drawing Sheets

FLUID MACHINE HAVING A PAIR OF ROTORS AND A SILENCER

BACKGROUND OF THE INVENTION

1. Field of the Invention

The present invention relates to a fluid machine as a compressor to be used for a super charger of a vehicle, for example.

2. Description of Related Art

There has been disclosed in Japanese Patent Application Laid-Open No. 54-54309 (1979) "a silencing apparatus 201 of a positive-displacement fluid machine" as shown in FIG. 1. This silencing apparatus 201 is disposed at a discharge opening 205 of a screw-type compressor 203, and the silencing apparatus 201 is configured by uniting an expansion silencer 207 and a sound absorbing silencer 209.

The expansion silencer 207 is composed of a reflecting plate 211 and a pipe 213 which pierces through the reflecting plate 211. The sound absorbing silencer 209 is constituted so that a sound absorbing material 217 is provided to an inner wall of a casing 215.

A pressure pulsation of a discharge gas of the compressor 203 is reduced in the expansion silencer 207 by interference of a pressure component reflected from the reflecting plate 211 and a pressure component passing through the pipe 213, and further a pulsation pressure is reduced by the sound absorbing material 217 of the sound absorbing silencer 209 l so that the noise is silenced.

In addition, there has been disclosed in Japanese Utility Model Application Laid-Open No. 6-80026 (1994) "a compressor 219" as shown in FIG. 2, and in Japanese Utility Model Application Laid-Open No. 5-47373 (1993) "a mechanical supercharger 221" as shown in FIG. 3.

The compressor 219 and mechanical supercharger 221 are, similarly to the fluid machine of FIG. 1, screw-type compressors, and their driving forces are increased by speed increasing gear sets 223 and 255 so that rotors 231, 233, 235 and 237 are rotated synchronously via timing gear sets 227 and 229.

Gases inhaled from intake openings 239 and 241 are compressed between the rotors 231, 233, 235 and 237 and rotor chambers 243 and 245 so as to be discharged from discharge openings 247 and 249.

In the case of the compressor 219, because of necessity when the rotors 231 and 233 are mounted, an intake casing 251 which is provided with the intake opening 239 is formed separately from a main body section 253 provided with the rotor chamber 243. The intake opening 239 is provided so as to be right-angled with an axial direction of the rotors 231 and 233.

In the case of the mechanical supercharger 221, the intake opening 241 is provided so as to be substantially parallel with an axial direction of the rotors 235 and 237. Similarly to the compressor 219, in order to mount the rotors 235 and 237, the intake opening 241 is formed separately from a rotor chamber 245.

As mentioned above, the silencing apparatus 201 shown in FIG. 1 is mounted to an outside of the compressor 203, and it is large-sized so as not to lower an inlet efficiency. In the above-mentioned conventional fluid machines, there arises a serious problem of noises, and thus a large-sized silencer such as the silencing apparatus 201 is used in order not to lower the inlet efficiency. Such a large-sized silencer cannot be mounted internally, so it is mounted externally like the silencing apparatus 201.

In addition, when an equipment for a vehicle, for example, should be compact, a special silencer is used, but such a silencer has a complicated structure and is expensive.

Furthermore, since at the intake opening 241 ends other than discharging opening ends, there also arises noises, it is desirable to provide with silencing means on the intake opening 241 ends. However, depending upon restriction of space in the engine room of the vehicle, it is difficult to provide with the silencing means on the intake opening 241 ends in such a manner that the silencing means would be provided independently from the fluid machine.

SUMMARY OF THE INVENTION

The present invention has been achieved with such points in mind.

It therefore is an object of the present invention to provide a fluid machine having silencing means which is small-sized, light, cheap, and does not greatly influence an inlet efficiency.

It is another object of the present invention to provide a fluid machine of which the silencing means can be provided at least one of an existing space forming fluid channel on the intake opening side and an existing space forming a fluid channel on the discharge opening side, and which is not required with independent space.

To achieve the object, according to a first aspect of the present invention, there is provided a fluid machine of a first aspect comprises: a casing having an operating chamber provided in the casing; a pair of rotors rotatably mounted in the operating chamber, each rotors having each rotor shaft in each axial direction; an intake opening and discharge opening for fluid, the intake opening and discharge opening being connected with the operating chamber, respectively; and silencing means provided in at least one of an existing space forming fluid channel on the intake opening side and an existing space forming a fluid channel on the discharge opening side, wherein the existing spaces are located between the intake opening and the operating chamber and between the discharge opening and the operating chamber, respectively; and wherein at least one among the intake opening and the discharge opening of the fluid where the silencing means is disposed is provided so as to be at parallel with the rotor shafts.

In the fluid machine of the present invention, the silencing means, which is provided in at least one of the spaces forming the fluid channel on the intake opening side and discharge opening side, reduces a pulsation pressure of the fluid and quietness is improved.

In addition, since the spaces on the intake opening side and discharge opening side where the silencing means is provided exist in the fluid machine and have a large sectional area, there is no great influence upon an efficiency, and thus the efficiency and silencing effect are compatible with each other.

Further, since the existing spaces are utilized for providing the silencing means, over- sizing of the fluid machine due to the disposal of the silencing means can be prevented.

Moreover, since special silencing means is not required, a system utilizing the fluid machine can be constituted at low cost.

Further, in the structure that the intake opening and discharge opening of the fluid are disposed substantially parallel with the rotor shafts, since the fluid moves smoothly, the efficiency of the fluid machine is improved.

The invention of a second aspect provides the fluid machine of the first aspect, wherein the silencing means is composed of a plate member and one or plural orifice(s) which is (are) formed in the plate member.

In the structure where the orifices are used in the silencing means, the pulsation pressure is reduced by viscous resistance due to contraction and expansion occurring when the fluid passes through the orifices, and thus the quietness is improved.

Further, a number and diameter of the orifices and a thickness of the plate member (length of the orifices) can be selected desirably according to a frequency of a noise to be silenced, and thus the silencing effect can be improved greatly.

In addition, since the silencing means using the orifices has a particularly simple structure, its cost is low.

The invention of a third aspect provides the fluid machine of the second aspect, wherein the plate member is a flat plate disposed to be at substantially right angle to the flow of the fluid.

In addition, since the flat plate is used as the plate member, the plate member is processed easily, and thus the cost becomes low. Moreover, since the orifices are easily processed in the flat plate, the cost can be further reduced.

The invention of a fourth aspect provides the fluid machine of the second aspect, wherein the plate member is formed into a convex shape or concave shape with respect to the flow of the fluid.

In addition, since the plate member is formed into a convex or concave shape, a contact area with the fluid is increased, and thus more orifices can be provided, and the silencing effect is improved greatly.

The invention of a fifth aspect provides the fluid machine of the first aspect, wherein the silencing means is composed of plate members which are laminated with predetermined gaps; the gaps are forming orifices which are formed between the plate members; the silencing means has a hollow section; the silencing means has a cover member for covering the hollow section on one side; and the hollow section on the other side is positioned towards one of an upper stream side of the fluid and a lower stream side of the fluid.

In this structure, the orifices formed between the plate members laminated with predetermined gaps reduce the pulsation pressure of the fluid, and thus the effect equivalent to the structure of the first aspect is obtained.

Further, as for the orifices formed along an edge of the plate members having the hollow section, since their whole length is long, the silencing effect is extremely great.

In addition, since the silencing means where the plate members having the hollow section are laminated can let a much amount of the fluid pass therethrough from a whole circumferential direction of the plate members, the great silencing effect can be obtained, and since the flow resistance of the inlet air is small, the efficiency of the fluid machine is not lowered.

Further, in the silencing means having this structure, the silencing effect due to interference of a pressure component of the fluid reflected by the cover member and a pressure component of the fluid directly passing through the orifices can be expected. Moreover, since the gaps (orifices) between the plate members are long in a moving direction of the fluid, when the fluid passes, a rectifying action is generated, and the silencing effect due to the rectifying action can be also expected.

In addition, the silencing means from which such a great silencing effect can be obtained can be constituted by a small structure, and the silencing means can be disposed into the space smoothly due to the small structure, and thus it contributes largely to prevention of large-sizing of the fluid machine. Moreover, when a number of the plate members is increased or decreased, the efficiency and the silencing effect of the fluid machine can be adjusted easily.

Further, in the structure of the silencing means where the hollow section on one side is covered by the cover member and the hollow section on the other side is opened, the hollow section on the opened side may be positioned towards the upper stream side or the lower stream side of the fluid. In such a manner, the silencing means can cope widely with various fluid machines where disposal places and forms of disposal spaces differ.

The invention of a sixth aspect provides the fluid machine of the fifth aspect, wherein the plate members and the cover member are fixed by a bolt; and spacers with a predetermined thickness are disposed between the plate members.

In addition, the gaps between the plate members can be adjusted desirably by changing the thickness of the spacers. Moreover, the gaps between the plate members may be uniform or changed desirably according to a required sound absorbing characteristic.

In such a manner, the efficiency and the silencing effect are compatible with each other. Moreover, the structure where the plate members, spacers and cover member are fixed by the bolt is simple and low-cost.

The invention of a seventh aspect provides the fluid machine of the first aspect, wherein the silencing means is composed of the plate members and a pipe member which pierces through the plate members.

In the silencing means which is composed of the plate members and the pipe member which pierces through the plate members, the pulsation pressure of the pressure is reduced by interference of a pressure component of the fluid reflected by the plate members and a pressure component of the fluid passing through the pipe member, and the quietness is improved.

Further, a length and diameter of the pipe member can be adjusted desirably, and when they are set according to a noise frequency, the great silencing effect can be obtained. Moreover, when the length and diameter of the pipe member are changed, the pipe member can cope with various fluid machine where the noise frequency varies.

The invention of an eighth aspect provides the fluid machine of the seventh aspect, wherein plural silencing means are arranged in a series in relation to the flow direction of the fluid so that the fluid passes therethrough successively; and the pipe members of the respective silencing means are arranged so as not overlap each other in the flow direction of the fluid.

In addition, since the plural silencing means are arranged in a series, the silencing effect is improved greatly.

The invention of a ninth aspect provides the fluid machine of the first aspect, wherein the silencing means is a sound absorbing material which is disposed in a wall section of the space forming the fluid channel.

In addition, since the silencing means composed by disposing the sound absorbing material in the wall section of the space does not directly disturb the flow of the fluid, the lowering of the efficiency is extremely small.

Further, since the sound absorbing material is disposed in the wall section and thus the silencing means disposed across the channel is not obstructed, and the lowering of the efficiency is extremely small, the silencing means using the sound absorbing material can be used also as the silencing means of another form disposed across the channel, and thus the silencing effect can be reinforced.

The invention of a tenth aspect provides the fluid machine of one of the first through ninth aspects, wherein the intake opening and discharge opening of the fluid where the silencing means is disposed are formed separately from the operating chamber section of the casing.

In addition, since the intake opening and discharge opening of the fluid are formed separately from the operating chamber section of the casing, the assembly of the fluid machine is easy.

The invention of an eleventh aspect provides the fluid machine of one of the first through tenth aspects, wherein the operating chamber is a rotor chamber disposed in the casing; the operating chamber has male and female rotors which are rotated and have their screw-type teeth being engaged with each other in the rotor chamber; and the intake opening and the discharge opening of the fluid are disposed in the axial direction of the rotors.

The above is the screw-type fluid machine, and the silencing effect by the silencing means is effective particularly in this screw-type fluid machine where the pulsation of the pressure and noise are great.

According to a twelfth aspect of the present invention, there is provided a fluid machine, comprising: a casing having an operating chamber provided in the casing; a pair of rotors rotatably mounted in the operating chamber, each rotors having each rotor shaft in each axial direction; an intake opening and discharge opening for fluid, the intake opening and discharge opening being connected with the operating chamber, respectively; and silencing means provided in at least one of an existing space forming fluid channel on the intake opening side and an existing space forming a fluid channel on the discharge opening side, wherein the existing spaces are located between the intake opening and the operating chamber and between the discharge opening and the operating chamber, respectively; and wherein at least one among the intake opening and the discharge opening of the fluid where the silencing means is disposed is provided so as to be at right angle to the rotor shafts.

In addition, when the intake opening and discharge opening of the fluid are provided so as to be at substantially right angles to the rotor shafts, the fluid machine can be composed so as to be short in the axial direction. As a result, the fluid machine can be easily disposed in a small place. Moreover, at the intake opening and the discharge opening of the fluid which are disposed at substantially right angles to the rotor shafts, the wall section against which the moving fluid bumps is formed, and since the fluid bumps against the wall section, an energy of the pulsation pressure is reduced, and thus the improvement of the silencing effect can be expected.

The invention of a thirteenth aspect provides the fluid machine of the twelfth aspect, wherein the operating chamber is a rotor chamber disposed in the casing; the operating chamber has a pair of rotors which are rotated and have their convex and concave teeth formed parallel with the axes being engaged with each other in the rotor chamber; and the intake opening and discharge opening of the fluid are disposed in a radial direction of the rotors.

The above is a root-type fluid machine using the rotors having a cocoon-shaped section, and since the pulsation of the pressure and noise are great similarly to the screw-type fluid machine, the silencing effect by the silencing means is great particularly.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
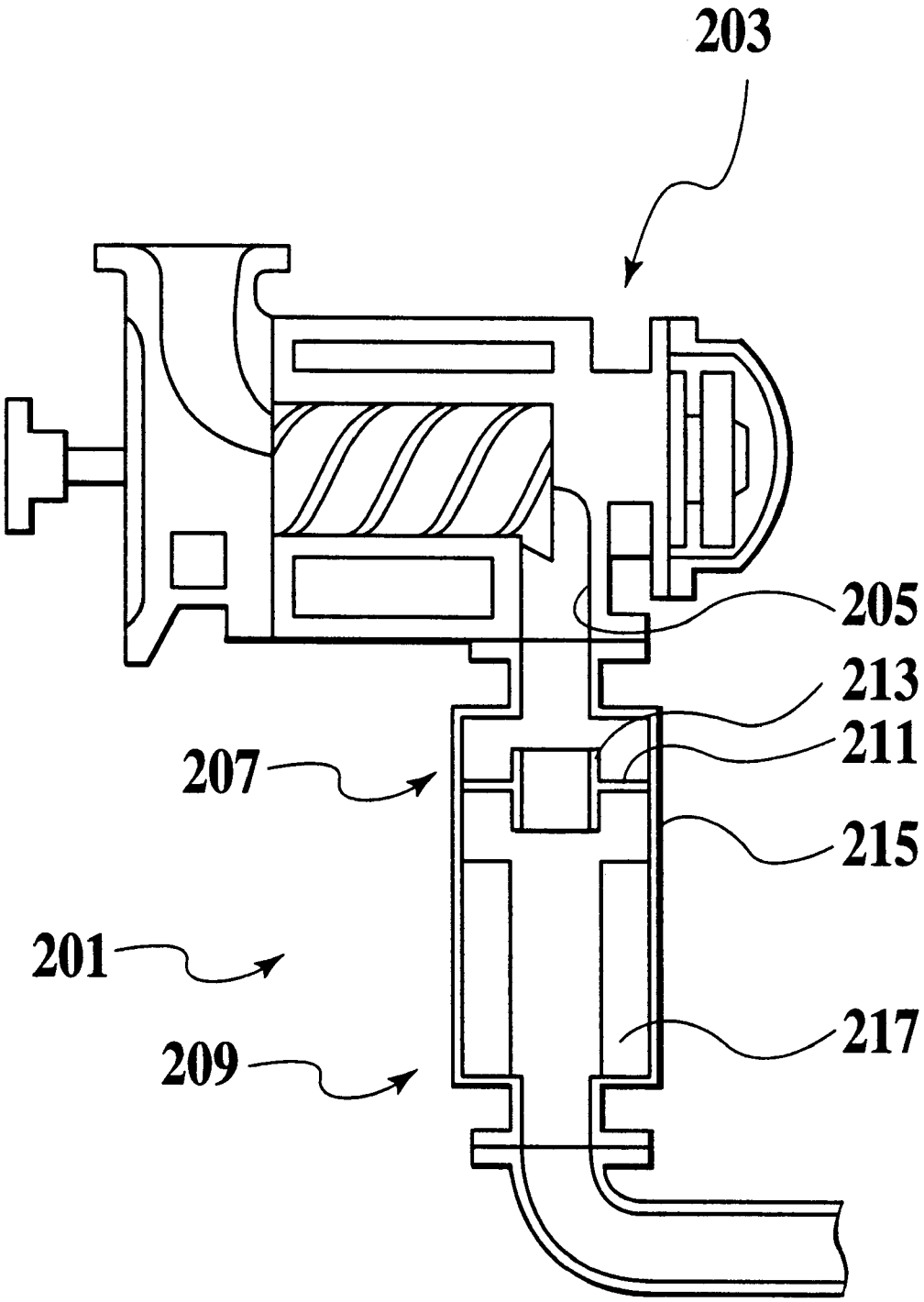
FIG.1 PRIOR ART
FIG. 1 is a sectional view showing a first conventional example.
Figure 2:
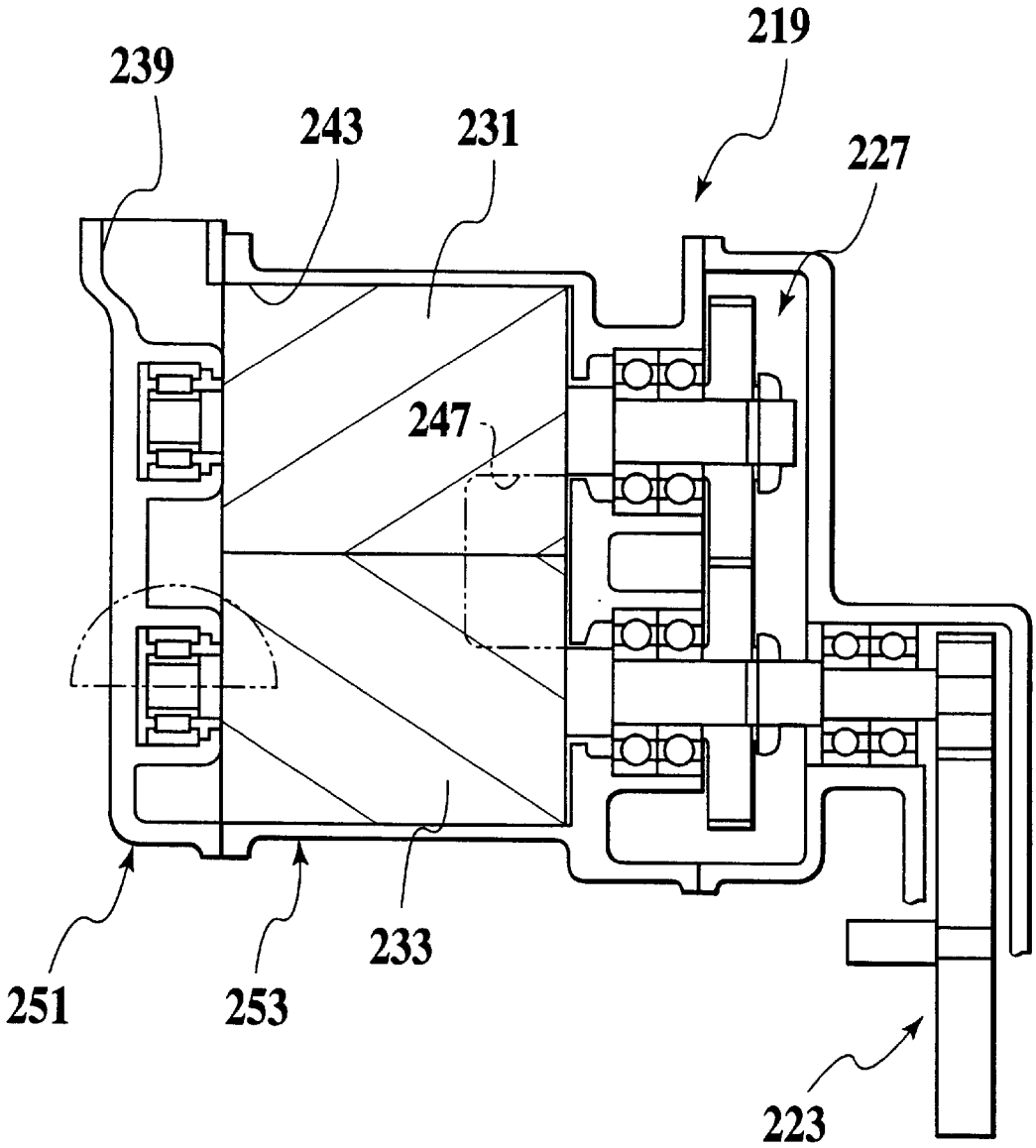
FIG.2 PRIOR ART
FIG. 2 is a sectional view showing a second conventional example.
Figure 3:
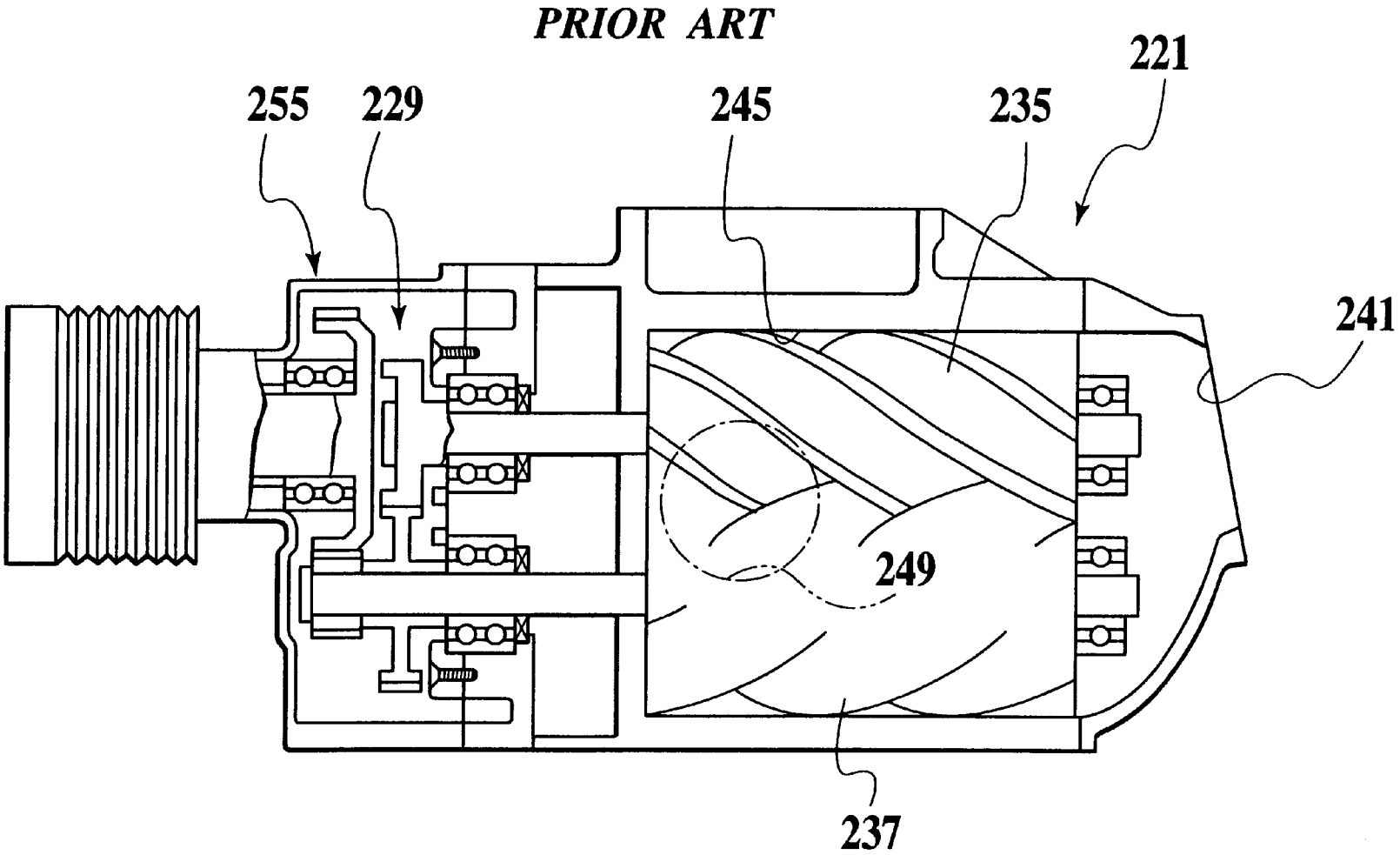
FIG.3 PRIOR ART
FIG. 3 is a sectional view showing a third conventional example.

There will be detailed below the preferred embodiments of the present invention with reference to the accompanying drawings. Like members are designated by like reference characters.

Figure 4:
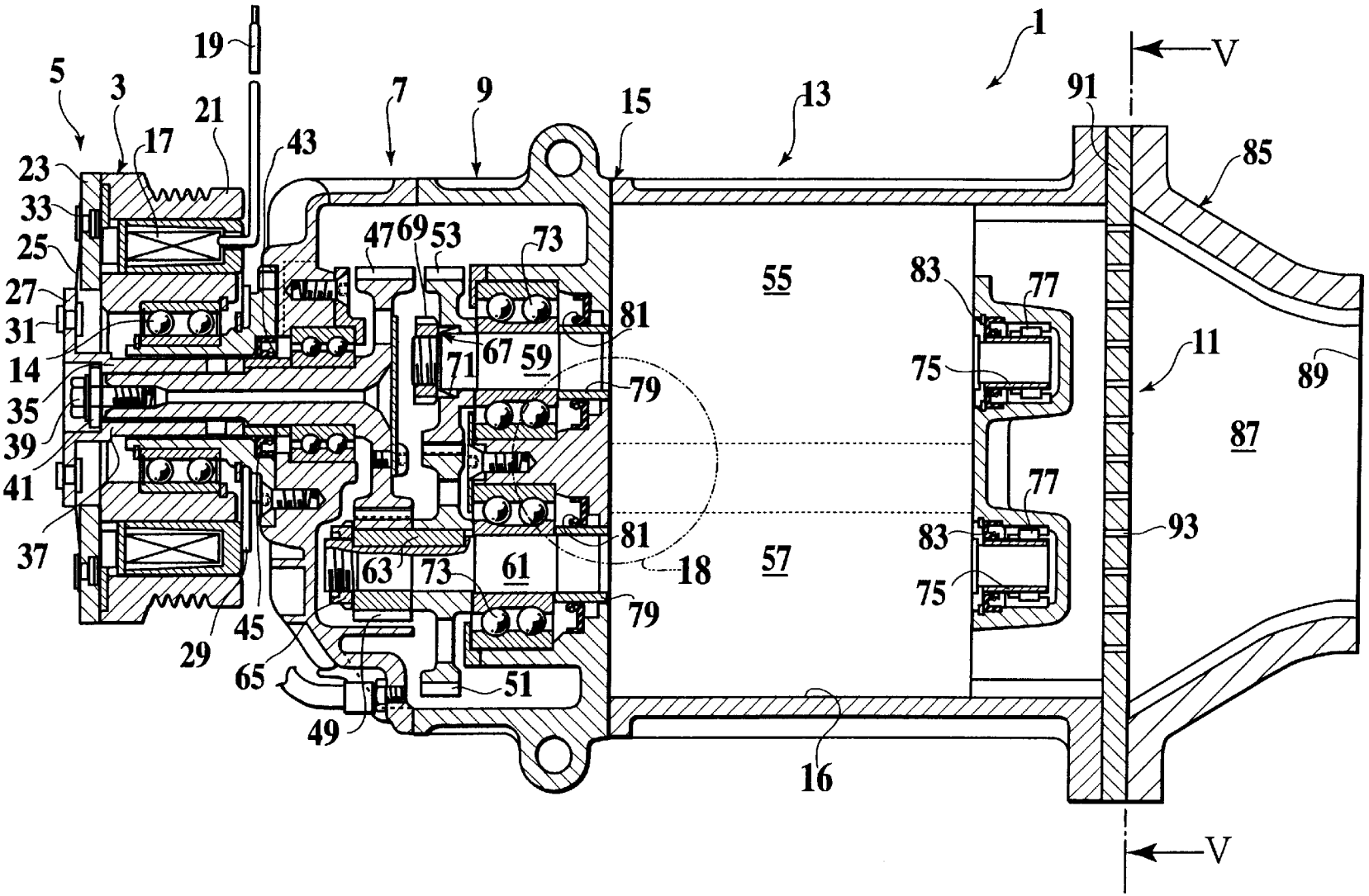
FIG. 4 is a sectional view showing a first embodiment of the present invention.

There will be described below a first embodiment of the present invention with reference to FIGS. 4 and 5. This embodiment has characteristics of the first, second, third, tenth, eleventh and twelfth aspects, and FIG. 4 shows a supercharger 1 utilizing this embodiment. Here, a right-and-left direction is a right-and-left direction in FIG. 4, and members to which reference numerals are not given are not shown.

As shown in FIG. 4, the supercharger 1 is composed of an input pulley 3, an electromagnetic clutch 5, a speed increasing gear set 7, a timing gear set 9, a screw-type compressor 13 having a silencer 11 (silencing means) (fluid machine of the first embodiment) and the like.

The input pulley 3 is supported to a compressor casing 15 by a bearing 14. The input pulley 3 is connected with a pulley on a crank shaft side via a belt, and it is driven to be rotated by a driving force of an engine.

The electromagnetic clutch 5 is composed of an electromagnetic coil 17 and its lead line 19, a yoke 21 of the electromagnetic coil 17, an armature 23, a spring 25, a flange member 27 and the like. The yoke 19 is fixed to the compressor casing 15 by a connecting member 29.

The armature 23 is connected with the flange member 27 by the spring 25 and minute screws 31 and 33. A boss section 35 of the flange member 27 is spline-connected with an input shaft 37 and fixed by a bolt 39 and a washer 41.

When the electromagnetic coil 17 is magnetized, the spring 25 is deflected and the armature 23 is attracted to the input pulley 3 side, and the electromagnetic clutch 5 is connected so that rotation of the engine is transmitted to the input shaft 37. When the magnetization of the electromagnetic coil 17 is stopped, the armature 23 is removed from the input pulley 3 by a force of the spring 25, and the connection of the electromagnetic clutch 5 is released so that the input shaft 37 is cut off from the engine side. In such a manner, the engine is connected/disconnected with/from the supercharger 1 by the electromagnetic clutch 5.

A collar 43 is mounted to the input shaft 37, and a seal 45 is provided between the collar 43 and the casing 15 so that an oil leakage to the outside of the casing 15 is prevented.

The speed increasing gear set 7 is composed of speed increasing gears 47 and 49 having a large diameter and small diameter which are engaged with each other, and the timing gear set 9 is composed of timing gears 51 and 53 having a large diameter and small diameter which are engaged with each other. The air compressor 13 has a compressor casing 15 which is formed with a operating chamber acting as a rotor chamber 16. The air compressor 13 also has female-type and male-type screw rotors 55 and 57, and the respective rotors 55 and 57 are formed so that rotor shafts 59 and 61 are fixed to center holes of rotor main bodies.

The speed increasing gear 47 having a large diameter is formed integrally with a right end of the input shaft 37, and the speed increasing gear 49 having a small diameter and the timing gear 51 having a large diameter are connected with the rotor shaft 61 by a key 63 so as to be fixed by a nut 65. The timing gear 53 having a small diameter is connected with the rotor shaft 59 via a tape ring fixing mechanism 67.

This tape ring fixing mechanism 67 locates the screw rotors 55 and 57 in rotational direction in such a manner that after teeth of the screw rotors 55 and 57 are engaged in a state that they do not contact with each other and the timing gear 53 is engaged with the timing gear 51, a nut 69 is clamped so that a taper ring 71 is pushed between the timing gear 53 and the rotor shaft 59 and the timing gear 53 is locked. When the timing gear set 9 is located in such a manner, the rotors 55 and 57 are rotated in opposite directions while their teeth are engaged without contact.

As for the rotor shafts 59 and 61 of the screw rotors 55 and 57, their left ends are supported to the casing 15 by ball bearings 73 and their right ends are supported to the casing 15 by roller bearings 77. Moreover, seals 81 are provided between collars 79 mounted to the left ends of the rotor shafts 59 and 61 and the casing 15, and seals 83 are provided between collars 75 at the right ends and the casing 15, and those seals prevent a leakage of inlet air.

An intake casing 85 is fixed to a right end of the casing 15 across the silencer 11. This intake casing 85 (inlet opening which is provided separately from the casing 15) is connected from a space 87 (existing space forming a fluid channel at the inlet opening side) via an intake opening 89 (inlet opening) to an inlet air channel of the engine. The intake opening 89 is formed parallel with the axial direction (moving direction of inlet air) of the rotors 55 and 57.

The driving force of the engine inputted from the pulley 3 is speed-increased by the speed increasing gear set 7, and rotates the screw rotors 55 and 57 via the timing gear set 9 so as to drive the compressor 13. The driven compressor 13 press-feeds an inlet air inhaled through the intake casing 85 and the silencer 11 to the axial-left direction between the screw rotors 55 and 57, and discharges it from a discharge opening 18 (flux opening) provided at the left end and supercharges the engine.

Figure 5:
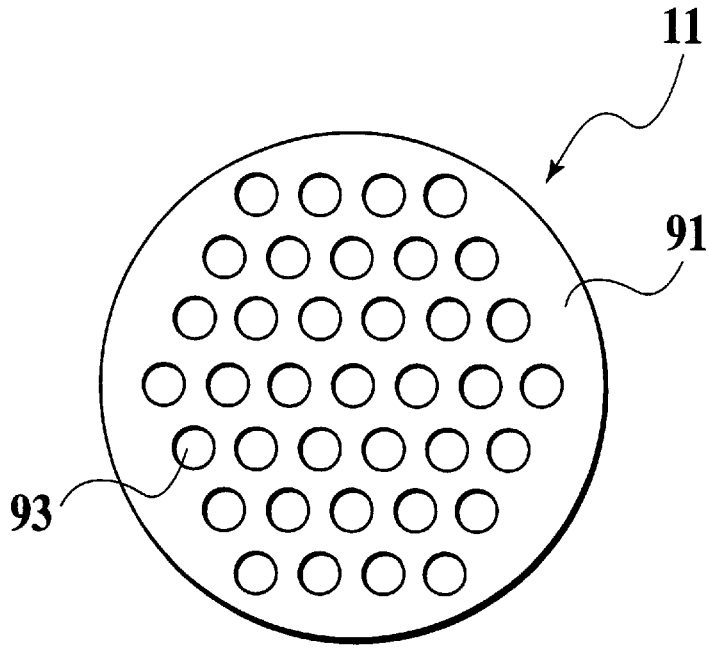
FIG. 5 is a view in the direction of V—V in FIG. 4.

As shown in FIGS. 4 and 5, the silencer 11 is composed by providing a lot of orifices 93 in a disk 91 (flat plate: plate member).

When passing through the orifices 93, the inlet air is contracted and after passing therethrough, it is expanded. At this time, a pulsation pressure is reduced by viscous resistance of the inlet air and silenced so that quietness of the compressor 13 is improved.

Here, a number and diameter of the orifices 93 and a thickness of the disk 91 (length of the orifices 93) can be selected desirably according to a frequency of a noise to be silenced, and thus the silencing effect of the silencer 11 can be improved greatly. In such a manner, the supercharger 1 is constituted.

As mentioned above, in the supercharger 1, the pulsation pressure of the inlet air is reduced by the silencing effect of the silencer 11 provided in the space 87 on the intake side of the compressor 13, and thus the quietness is improved. Moreover, the space 87 is a portion whose sectional area is large, and even if the silencer 11 is provided therein, a great influence is not exerted on the inlet efficiency, and thus the inlet efficiency and silencing effect are compatible with each other.

In addition, the space 87 is an existing space which is conventionally provided in the compressor 13, and since the existing space 87 is utilized, even if the silencer 11 is provided, the compressor 13 is prevented from becoming large-sized. Since the silencer 11 using the orifices 93 is not a special constitution, the supercharging system of the supercharger 1 can be constituted at a low cost.

Further, the disk 91 as a flat plate is processed easily, and thus the cost is reduced, and since the orifices 93 are easily processed in the flat plate, the cost can be further reduced.

In addition, the silencing effect by the silencer 11 becomes effective particularly in the screw-type compressor 13 where pulsation of the pressure and noise are great. Moreover, since the intake casing 85 is formed separately from the casing 15, the assembly of the rotors 55 and 57 is easy.

Further, since the intake opening 89 is formed parallel with the rotors 55 and 57, the inlet air moves smoothly, and thus the inlet efficiency of the compressor 13 is high.

Figure 6:
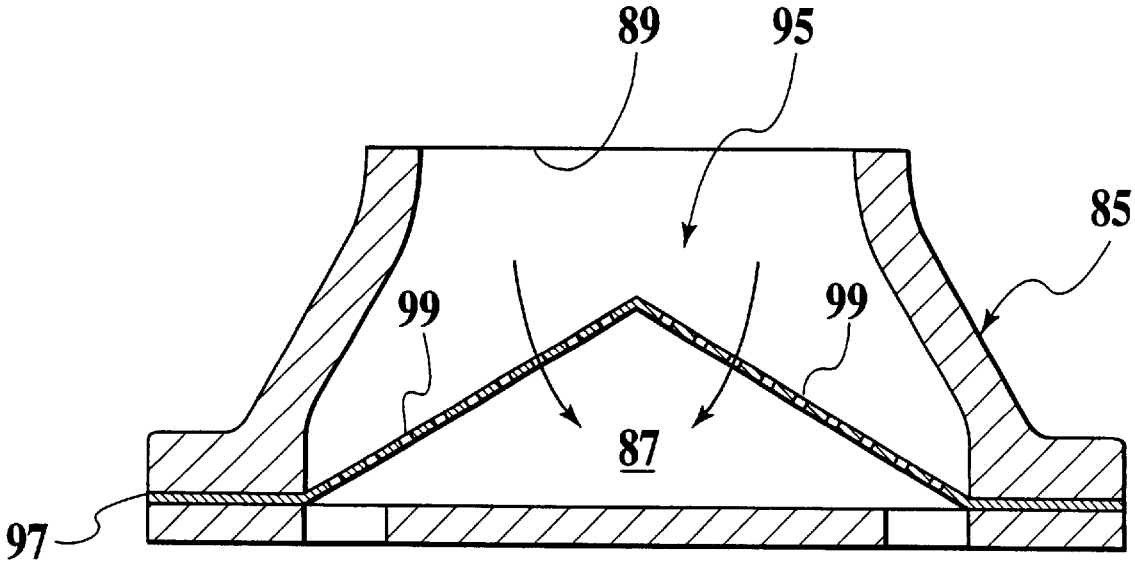
FIG. 6 is a sectional view showing a silencer used in a second embodiment of the present invention.
Figure 7:
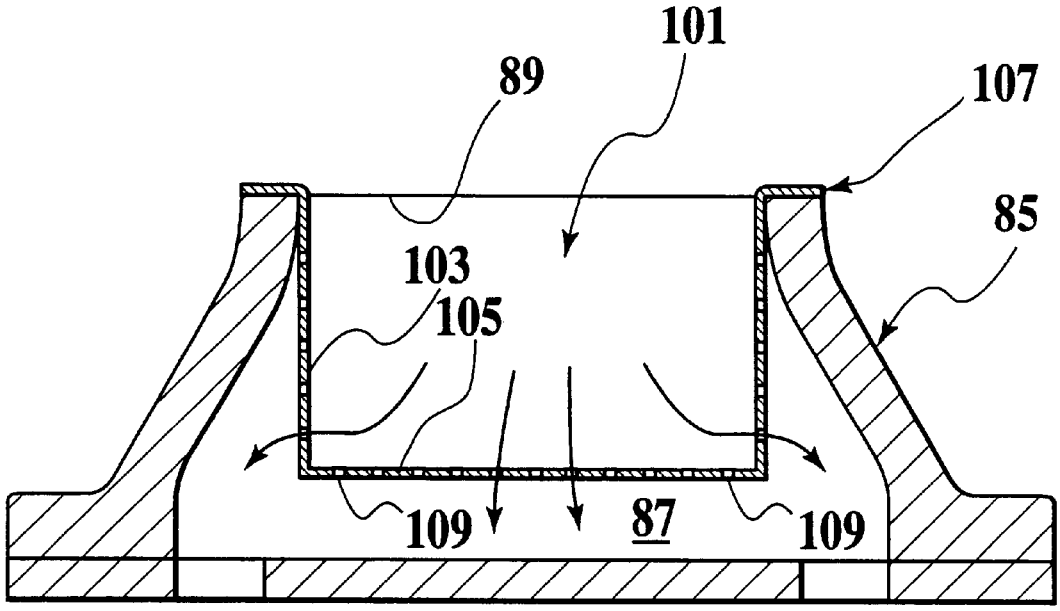
FIG. 7 is a sectional view showing a silencer used in a third embodiment of the present invention.

The following will describe second and third embodiments with reference to FIGS. 6 and 7. These have the characteristics of the fourth, tenth and eleventh aspects. A plate member of the silencer provided with a lot of orifices may not be a flat plate unlike the above-mentioned silencer 11. The embodiments show such an example.

As shown in FIG. 6, a silencer 95 used in the second embodiment is composed by providing a lot of orifices 99 in a convex and conical plate 97 (plate member) to a flow direction of the inlet air. The inlet air inhaled from the intake opening 89 of the intake casing 85 passes through the respective orifices 99 as shown by an arrow, and a pulsation pressure is reduced by viscous resistance of the inlet air due to contraction and expansion at this time, and a noise is silenced so that the quietness is improved.

In addition, as shown in FIG. 7, a silencer 101 used in the third embodiment is composed by providing a lot of orifices 109 in a plate member 107 where a top section 105 is provided at a cylindrical section 103. The plate member 107 is formed into a concave shape towards a flow of the inlet air so as to be mounted to the intake opening 89 side of the intake casing 85.

The inlet air inhaled from the intake opening 89 passes through the respective orifices 109 as represented by an arrow, and a pulsation pressure is reduced by viscous resistance of the inlet air due to contraction and expansion at this time, and a noise is silenced so that the quietness is improved.

Since both the silencers 95 and 101 shown in FIGS. 6 and 7 are formed so that the conical plate 97 and plate member 107 have respectively a convex shape and concave shape, a contact area with the inlet air is increased, and thus a larger number of the orifices 99 and 109 can be provided. As a result, the silencing effect is improved greatly.

In addition, similarly to the first embodiment, since the intake casing 85 is formed separately from the casing 15, the assembly of the rotors 55 and 57 is easy, and since the intake opening 89 is formed parallel with the rotors 55 and 57, the inlet air moves smoothly and thus the inlet efficiency of the compressor 13 is high.

Figure 8:
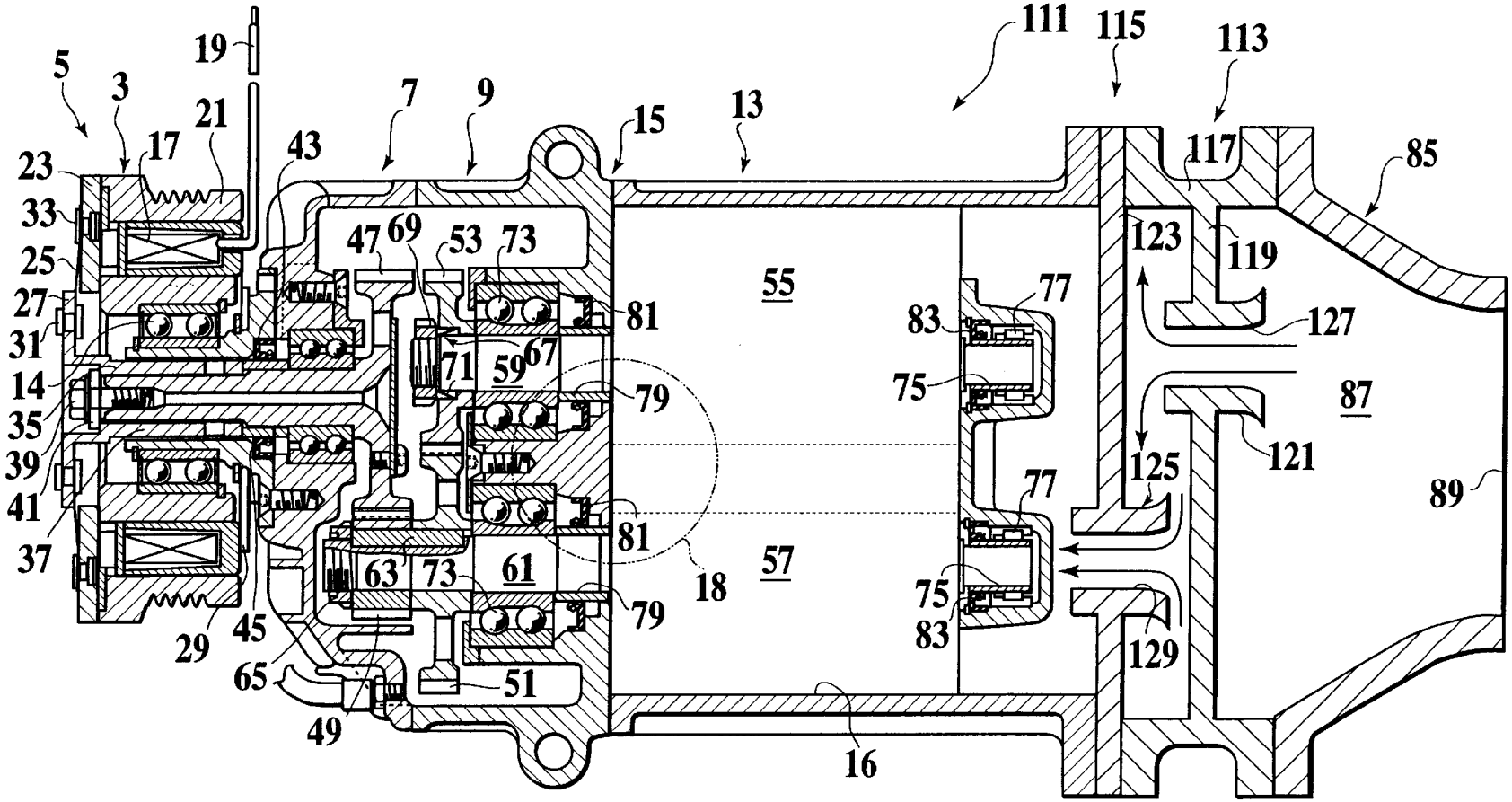
FIG. 8 is a sectional view showing a fourth embodiment of the present invention.

The following will describe a fourth embodiment of the present invention with reference to FIG. 8. This embodiment has the characteristics of the first, seventh, eighth, tenth, eleventh and twelfth aspects, and FIG. 8 shows a supercharger 111 using this embodiment. Moreover, the right-and-left direction is a right-and-left direction in FIG. 8.

Here, in FIG. 8 and the description and the embodiment, the same reference numerals are given to the members whose functions are the same as those in the first embodiment.

As shown in FIG. 8, the supercharger 111 is composed of the input pulley 3, the electromagnetic clutch 5, the speed increasing gear set 7, the timing gear set 9, the screw-type compressor 13 (fluid machine of the fourth embodiment) having two-staged silencers 113 and 115 (silencing means) and the like.

The intake casing 85 is fixed to the right end of the compressor casing 15 across the silencers 113 and 115. The intake casing 85 is connected with the inlet channel of the engine from the space 87 via the intake opening 89.

The driving force of the engine inputted from the pulley 3 is speed-increased by the speed increasing gear set 7 and rotates the screw rotors 55 and 57 via the timing gear set 9 so as to drive the compressor 13. The driven compressor 13 press-feeds the inlet air inhaled through the intake casing 85 and the silencer 97 to the axial-left direction between the screw rotors 55 and 57, and discharges the inlet air from the discharge opening (flux opening) provided at the left end so as to supercharge the engine.

The first-stage silencer 113 is composed of a reflecting plate 119 (plate member) formed in a boss section 117 and a pipe 121 (pipe member) which pierce through the reflecting plate 119. The second-stage silencer 115 is composed of a reflecting plate 123 (plate member) and a pipe 125 (pipe member) which pierces through the reflecting plate 123.

The respective silencers 113 and 115 are arranged in a series so that the inlet air is passed therethrough successively, and the pipes 121 and 125 are arranged in shifted positions so as not to overlap each other in the flow direction of the inlet air. Enlarged diameter sections 127 and 129 whose diameter is enlarged into a bell shape are provided on upper stream sides of the pipes 121 and 125 so that the inlet efficiency of the inlet air is improved.

As for the inlet air inhaled from the intake opening 89 of the intake casing 85 via the space 87, pulsation of the pressure is reduced by interference of a pressure component of the inlet air reflected by the reflecting mirror 119 of the first-stage silencer 113 and a pressure component of the inlet air passing through the pipe 121, and a noise is silenced. The inlet air which passed through the silencer 113 flows into the silencer 115, and similarly pulsation of the pressure is reduced by interference of a pressure component of the inlet air reflected by the reflecting plate 123 and a pressure component of the inlet air passing through the pipe 125, and a noise is silenced.

In such a manner, since the silencers 113 and 115 are arranged in a series, the silencing effect is improved greatly. Here, when a length and diameter of the pipes 121 and 125 are set according to a frequency of a noise, the great silencing effect can be obtained.

In addition, when the length and diameter of the pipes 121 and 125 are changed, the pipes 121 and 125 can cope with various fluid machine in which a noise frequency is different. In such a manner, the supercharger 111 is constituted.

As mentioned above, in the supercharger 111, the silencing effect of the silencers 113 and 115 provided in the space 87 on the inlet side of the compressor 13 reduces the pulsation pressure of the inlet air, and thus the quietness is improved. Moreover, since the silencers 113 and 115 are provided in the space 87 whose sectional area is large, an influence upon the inlet efficiency is avoided, and thus the inlet efficiency and silencing effect are compatible with each other. Further, since the existing space 87 is utilized, even if the silencers 113 and 115 are provided, the compressor 13 is not large-sized.

In addition, since the silencers 113 and 115 do not have a special structure, the supercharging system of the supercharger 111 can be constituted at a low price. Moreover, since the two silencers 113 and 115 are arranged in a series, the silencing effect is improved greatly.

Further, the silencing effect by the silencers 113 and 115 is effective particularly in the screw-type compressor 13 in which the pulsation of the pressure and noise are great.

In addition, similarly to the first embodiment, since the intake casing 85 is provided separately, the assembly of the rotors 55 and 57 is easy, and since the intake opening 89 is formed parallel with the axial direction of the rotors 55 and 57, the inlet air moves smoothly and the inlet efficiency of the compressor 13 is high. Here, three or more stage silencers may be arranged in a series.

Figure 9:
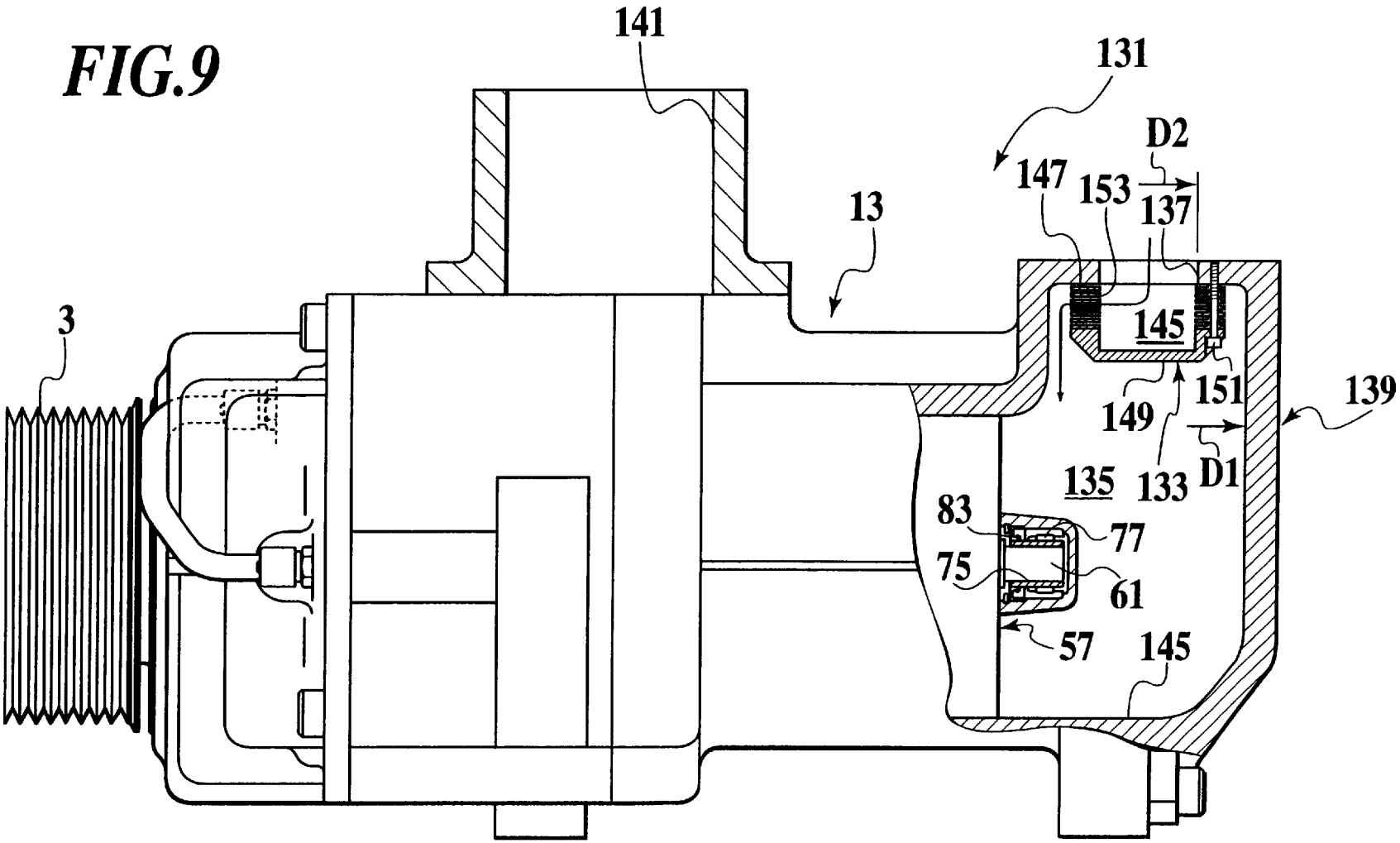
FIG. 9 is a partial sectional view showing a fifth embodiment of the present invention.

The following will describe a fifth embodiment of the present invention with reference to FIG. 9. This embodiment has the characteristics of the first, fifth, sixth, tenth and twelfth aspects, and FIG. 9 shows a supercharger 131 using this embodiment. Moreover, the right-and-left direction is a right-and-left direction in FIG. 9.

Here, in FIG. 9 and the description of the fifth embodiment, the same reference numerals are given to the members whose functions are the same as those in the first and fourth embodiments.

As shown in FIG. 9, the supercharger 131 is composed of the input pulley 3, the electromagnetic clutch 5, the speed increasing gear set 7, the timing gear set 9, the screw-type compressor 13 (fluid machine of the fifth embodiment) having a silencer 133 and the like. An intake section 139 having a space 135 and an intake opening 137 is formed at the right end of the casing 15. The space 135 is connected with the inlet channel of the engine via the intake opening 137.

The intake opening 137 is opened in a direction at substantially right angles to the axial direction of the rotors 55 and 57, and the silencer 133 is positioned on an inner side of the intake opening 137.

In addition, a discharge opening 141 (flux opening), which is opened in a direction at substantially right angles to the axial direction of the rotors 55 and 57, is provided in the casing 15.

The driving force of the engine inputted from the pulley 3 is speed-increased by the speed increasing gear set 7 and rotates the screw rotors 55 and 57 via the timing gear set 9 so as to drive the compressor 13. The driven compressor 13 inhales the inlet air from the intake opening 137 via the silencer 133, and press-feeds the inlet air, which bumps against a wall section of the space 135 and whose direction is changed towards the rotors 55 and 57, to the axial-left direction between the screw rotors 55 and 57 and discharges the inlet air from the discharge opening 141 so as to supercharge the engine.

The silencer 133 is composed of a lot of plate members 147 having a hollow section 145, spacers forming predetermined gaps between the respective plate members 147 and a cover member 149 so that they are fixed to the intake opening 137 side of the intake member 139 by a bolt 151. Orifices 153 are formed between the plate members 147 which are laminated with predetermined gaps via the spacers.

In addition, the cover member 149 covers the hollow section 145 on one side of the plate members 147, and the hollow section 145 on the other side (opened side of the hollow section 145) is arranged towards the upper stream side. As represented by an arrow, the inlet air passes through the orifices 153 so as to be inhaled to the space 135 and is contracted and expanded before and after the orifices 153. The pulsation pressure is reduced by the viscous resistance of the inlet air at this time, and thus a noise is silenced so that the quietness is improved.

Further, since an inner diameter D1 of the space 135 is larger than an inner diameter D2 of the intake opening 137, when moving from the intake opening 137 to the space 135, the inlet air is expanded, and the silencing effect is improved by the viscous resistance due to this expansion. In such a manner, the supercharger 131 is constituted.

As mentioned above, in the supercharger 131, the silencing effect of the silencer 133 provided in the space 135 on the intake side of the compressor 13 reduces the pulsation pressure of the inlet air, and thus the quietness is improved. Moreover, since the silencer 133 is provided in the space 135 whose sectional area is large, an influence upon the inlet efficiency is avoided, and thus the inlet efficiency and the silencing effect are compatible each other. Further, since the existing space 135 is utilized, even if the silencer 133 is disposed, the compressor 13 is not large-sized.

In addition, since the silencer 133 in which the plate members 147 having the hollow section 145 are laminated can let a large amount of the inlet air pass from a whole circumference of the plate members 147, the great silencing effect can be obtained, and since the fluid resistance of the inlet air is small, the inlet efficiency of the compressor 13 is not lowered. Moreover, since a whole length of the orifices 153 formed along the edge of the plate members 147 is long, the silencing effect of the silencer 133 is extremely great.

In addition, since the pulsation pressure is reduced by the interference of the pressure component of the inlet air reflected by the cover member 149 and the pressure component of the inlet air directly passing through the orifices 153, the silencing effect is improved. Moreover, the expansion of the inlet air when the inlet air moves from the intake opening 137 to the space 135 improves the silencing effect.

Furthermore, since the gaps between the plate members 147 (orifices 153) are long in the flow direction of the inlet air, when the inlet air passes, a rectifying action occurs, and thus the silencing effect is further improved.

In addition, the silencer 133 which provides such a great silencing effect can be composed to be small-sized, and the small-sized structure makes it possible to provide the silencer 133 in the space 135 smoothly. As a result, such a silencer 133 contributes largely to prevention of large-sizing of the compressor 13.

Further, in the silencer 133, the gaps between the plate members 147 can be adjusted desirably by changing a thickness of the spacers, and the gaps between the plate members 147 may be uniform or changed desirably according to a required sound absorbing characteristic. In such a manner, the inlet efficiency and the silencing effect are greatly compatible with each other.

In addition, the structure such that the plate members 147 and the spacers are fixed by the bolt 151 is simple and low-cost. Moreover, the inlet efficiency and the silencing effect can be changed easily by increasing/reducing a number of the plate members 147.

Further, since the intake opening 137 is formed so as to be at right angles to the axial direction of the rotors 55 and 57, the inlet air bumps against the wall section 143 while moving, and an energy of the pulsation pressure is reduced and the silencing effect is further improved.

In addition, since the intake opening 137 is formed so as to be at right angles to the axial direction of the rotors 55 and 57, the compressor 13 (supercharger 131) becomes compact in the axial direction, and thus the disposal in a small engine room becomes easy. Moreover, since the silencer 133 does not have a special structure, the supercharging system of the supercharger 131 can be constituted at a low cost.

In addition, the silencing effect of the silencer 133 is effective particularly in the screw-type compressor 13 where the pulsation of the pressure and noise are great. Moreover, in the silencer 133 in which the hollow section 145 on one side is covered by the cover member 149 and the hollow section 145 on the other side is opened, the opened hollow section 145 is positioned towards the upper stream side of the inlet air as mentioned above, and besides, it may be positioned towards the lower stream side. In such a manner, the silencer 133 can cope widely with various conditions such that the disposal place and disposal space may differ.

Furthermore, in another arrangement according to variation of design for the engine room, as in the first to the forth embodiments shown in FIGS. 4 to 8, the intake opening 137 can be arranged in parallel to the axes of the rotors 55, 57.

Figure 10:
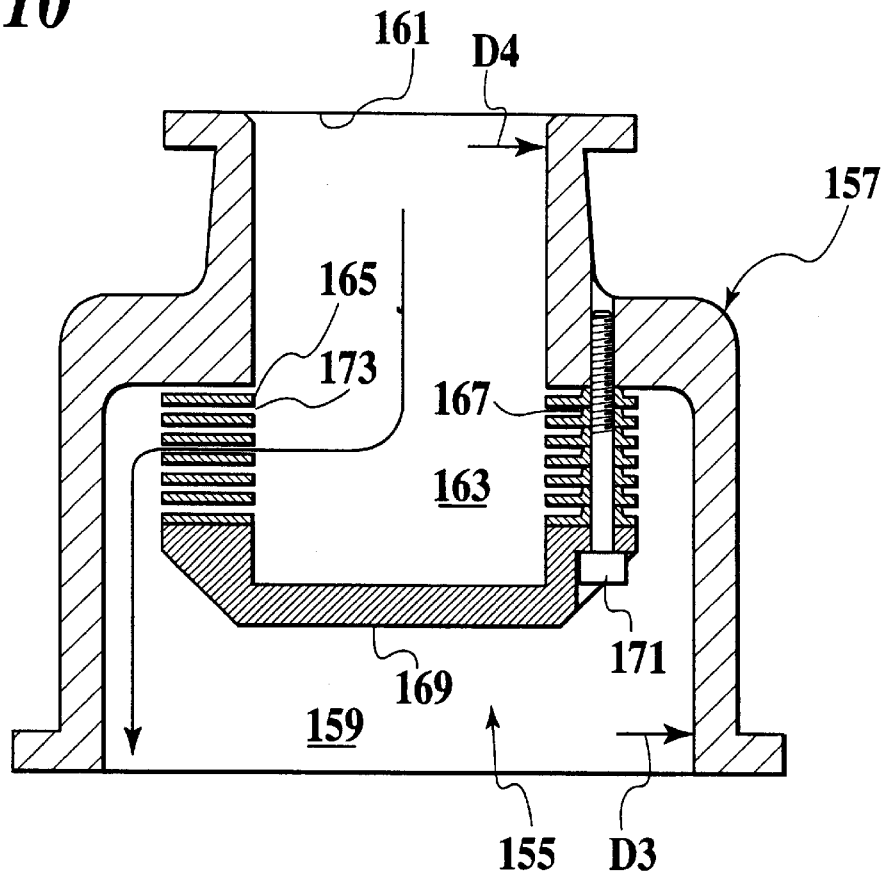
FIG. 10 is a sectional view showing a silencer used in a sixth embodiment of the present invention.
Figure 11:
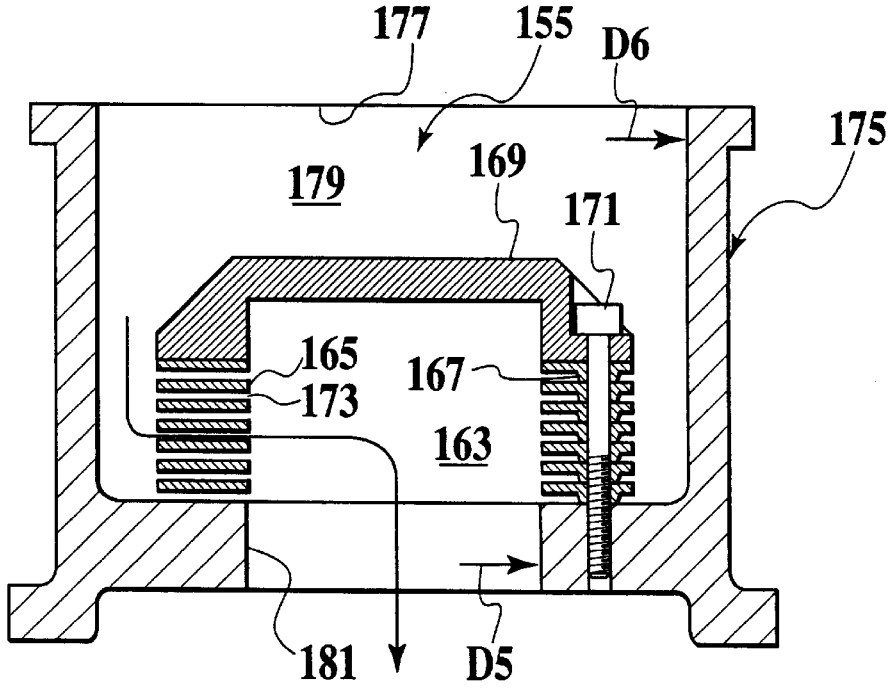
FIG. 11 is a sectional view showing a silencer used in a seventh embodiment of the present invention.

The following will describe sixth and seventh embodiments with reference to FIGS. 10 and 11. Silencers to be used in these embodiments have a structure similar to that of the silencer 133, and they has characteristics of the fifth, sixth, nineteenth and eleventh aspects.

A silencer 155 to be used in the sixth embodiment is, as shown in FIG. 10, fixed to an intake casing 157 (flux opening provided separately from the casing 15). This intake casing 157 is connected with the inlet channel of the engine from a space 159 (existing space forming the fluid channel on the flux opening side) via an intake opening 161.

The silencer 155 is composed of a lot of plate members 165 having a hollow section 163, spacers 167 for forming predetermined gaps between the plate members 165, and a cover member 169 so that they are fixed to the intake opening 161 side of the intake casing 157 by a bolt 171. Orifices 173 are formed between the plate members 165 which are laminated with predetermined gaps via the spacers 167.

In addition, the cover member 169 covers the hollow section 163 on one side of the plate members 165, and the hollow section 163 on the other side (opened side of the hollow section 163) is positioned towards the upper stream side of the inlet air. As represented by an arrow, the inlet air passes through the orifices 173 and is inhaled to the space 159, and at this time the pulsation pressure is reduced by the viscous resistance due to contraction and expansion of the inlet air occurring before and after the orifices 173, and a noise is silenced so that the quietness is improved.

Furthermore, since an inner diameter D3 of the space 159 of the intake casing 157 is larger than an inner diameter D4 of the intake opening 161, when moving from the intake opening 161 to the space 159, the inlet air is expanded, and the silencing effect due to the viscous resistance is improved. Further, the silencer 155 provides an effect equivalent to that of the silencer 133.

In the sixth embodiment, the silencer 155 is constituted so that the opened side of the hollow section 163 is positioned towards the upper stream side of the inlet air, but the opened side of the hollow section 163 may be positioned towards the lower stream side of the inlet air.

FIG. 11 shows the seventh embodiment.

The silencer 155 is fixed to an intake casing 175 (flux opening provided separately from the casing 15). The intake casing 175 is connected with inlet channel of the engine via an intake opening 177 so as to be interconnected with a throttle section 181 on the rotors 55 and 57 side from an space 179 (existing space forming the fluid channel on the flux opening side).

In the silencer 155, the opened side of the hollow section 163 is fixed to the throttle section 181 side of the intake casing 175 towards the lower stream side of the inlet air by the bolt 171. As represented by an arrow, the inlet air passes through the orifices from the space 179 and is inhaled to the throttle section 181. As a result, the pulsation pressure is reduced by the viscous resistance due to the contraction and expansion of the inlet air, and a noise is reduced so that the quietness is improved.

In addition, since an inner diameter D5 of the throttle section 181 of the intake casing 175 is smaller than an inner diameter D6 of the intake opening 177 (space 179), when moving from the space 179 to the throttle section 181, the inlet air is contracted, and thus the silencing effect due to the viscous resistance is improved.

In addition, the seventh embodiment provides the effect equivalent to that of the sixth embodiment. Since in the sixth and seventh embodiments the intake casings 157 and 175 are formed separately from the casing 15, the assembly of the rotors 55 and 57 is easy, and since the intake openings 161 and 177 are formed parallel with the rotors 55 and 57, the inlet air moves smoothly and thus the inlet efficiency of the compressor 13 is high.

Figure 12:
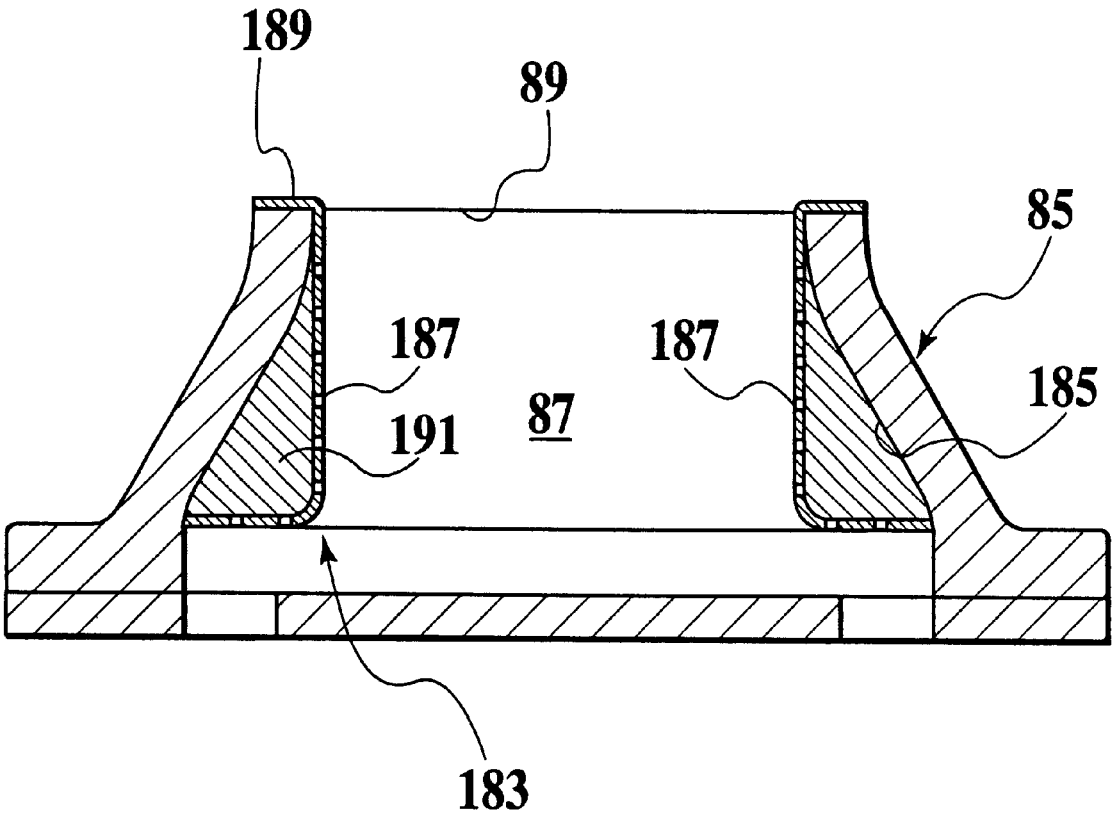
FIG. 12 is a sectional view showing a silencer used in an eighth embodiment of the present invention.

The following will describe an eighth embodiment with reference to FIG. 12. This embodiment has the characteristic of the ninth aspect.

A silencer 183 to be used in the eighth embodiment is mounted to an inner wall 185 of the space 87 of the intake casing 85. The silencer 183 is composed of a holding member 189 provided with a lot of holes 187 and a sound absorbing material 191. The holding member 189 is fixed to an inner side of the intake casing 85, and the sound absorbing material 191 is charged between the holding member 189 and the inner wall 185.

When the inlet air passes through the space 87 of the intake casing 85, the pulsation pressure of the inlet air is absorbed by the sound absorbing material 191 through the holes 187 of the holding member 189, and a noise silenced so that the quietness is improved. Since the silencer 183 mounted to the inner wall 185 of the space 87 does not prevent the flow of the inlet air, the lowering of the inlet efficiency is extremely small.

Further, since the silencer 183 does not disturb the silencer provided across the flow channel and the lowering of the efficiency is extremely small, the silencer 183 can be used in common as the silencers having the other forms provided across the flow channel (for example, the silencers 11, 95, 101, 113, 115, 133 and 155), and thus the silencing effect can be reinforced.

Here, unlike the embodiments, in the fluid machine of the present invention, the silencing means may be provided on the discharge opening side of the fluid or both on the intake opening side and discharging opening side. For example, in case the silencing means is provided at discharging opening end in the fluid machine shown in FIGS. 4 and 8, the rotors 55, 57 is designed in the reverse rotation against the present embodiment so that the fluid is flown from the present discharge opening 18 to the present intake opening 89, thereby permitting to provide another silencing means at the redesigned discharge opening end.

Moreover, unlike the embodiments, the fluid machine of the present invention is not limited to the screw-type fluid machine, as described in the thirteenth aspect, it may be a root-type fluid machine, for example. In the root-type fluid machine, since the pulsation of the pressure and noise are great not less than equivalently to the screw-type fluid machine, the silencing effect by the silencing means is particularly great.

In addition, the fluid machine of the present invention is not limited to the screw-type or root-type fluid machine, so the silencing effect can be obtained in all fluid machines where flowing of the fluid occurs such as a reciprocating-type fluid machine.

In this connection, the pair of rotors of the thirteenth aspect mounted in the root-type fluid machine can be replaced with male and female screw-type rotors to be mounted in the screw-type fluid machine.

Moreover, the fluid machine of the present invention may be used not only as a compressor and blower but also as a fluid pressure motor and an expanding machine for giving a fluid pressure and taking out rotation. For example, the fluid machine of the present invention may be used as a compressor to supply compressed air into a fuel cell or battery for a clean engine vehicle or electric motor vehicle.

The entire contents of Japanese Patent Application P10-121172 (filed Apr. 30, 1998) are incorporated herein by reference.

Although the invention has been described above by reference to certain embodiments of the invention, the invention is not limited to the embodiments described above. Modifications and variations of the embodiments descried above will occur to those skilled in the art, in light of the above teachings. The scope of the invention is defined with reference to the following claims.

What is claimed is:

1. A fluid machine, comprising:

a casing having an operating chamber provided therein;

a pair of rotors rotatable mounted in the operating chamber, each rotor having a rotor shaft in each axial direction;

an intake casing having an intake opening for fluid and surrounding an existing space;

a silencing means provided on at least one end of the intake casing;

wherein the existing space is located between the intake opening and the operating chamber;

wherein the silencing means is composed of a plate member and at least one orifice which is formed in the plate member; and wherein the plate member extends across the existing space of the intake casing.

2. A fluid machine according to claim 1, wherein the plate member is a flat plate disposed to be at substantially right angle to the flow of the fluid.

3. A fluid machine according to claim 1, wherein the plate member is formed into a convex shape or concave shape with respect to the flow of the fluid.

4. A fluid machine according to claim 1, wherein the plate member is mounted on the intake opening of the intake casing.

5. A fluid machine according to claim 4, wherein the plate member protrudes toward the existing space of the intake casing.

6. A fluid machine according to claim 5, wherein the plate member is located between the intake casing and the operating chamber of the casing so as to be sandwiched by the intake casing and the casing.

7. A fluid machine according to claim 5, wherein the plate member is a flat.

8. A fluid machine according to claim 6, wherein the plate member is a flat.

9. A fluid machine according to claim 7, wherein the plate member protrudes towards the existing space of the intake casing.

* * * * *